United States Patent [19]

Chuang

[11] Patent Number: 5,044,804

[45] Date of Patent: Sep. 3, 1991

[54] WRITING INSTRUMENT

[75] Inventor: Cheng-Hwa Chuang, Taipei, Taiwan

[73] Assignee: Pioneer Industrial Corp., Taipei, Taiwan

[21] Appl. No.: 451,122

[22] Filed: Dec. 14, 1989

[30] Foreign Application Priority Data

Jun. 7, 1989 [JP] Japan ..... 1-144516

[51] Int. Cl.[5] ..... B43K 27/08; B43K 23/00; A45D 40/20

[52] U.S. Cl. ..... 401/34; 401/35; 401/57; 401/88

[58] Field of Search ..... 401/35, 88, 57, 34, 401/37, 59, 90, 210; 446/127

[56] References Cited

U.S. PATENT DOCUMENTS

| | | | |
|---|---|---|---|
| 1,737,798 | 12/1929 | Kinzinger | 401/57 |
| 3,708,235 | 1/1973 | Kolomeir | 401/57 |
| 3,862,683 | 1/1975 | Koelichen | 401/35 X |
| 3,993,409 | 1/1976 | Hart | 401/57 X |
| 4,702,633 | 10/1987 | Schmidt | 401/35 X |

FOREIGN PATENT DOCUMENTS

| | | | |
|---|---|---|---|
| 357413 | 8/1922 | Fed. Rep. of Germany | 401/35 |
| 2514041 | 10/1976 | Fed. Rep. of Germany | 401/35 |
| 862042 | 3/1961 | United Kingdom | 446/127 |
| 2207641 | 2/1989 | United Kingdom | 401/35 |

*Primary Examiner*—Danton D. DeMille
*Attorney, Agent, or Firm*—Ladas & Parry

[57] ABSTRACT

A writing instrument in which plural cartridges are fitted and coupled in series with each other in their longitudinal direction so that the cartridges are removable from each other. Each of the cartridges comprises a tubular body having a tubular projection at one end of the tubular body and having an optionally shaped cross section, and a core unit inserted in the tubular projection so that the core unit is held in it. The tubular body has an insertion hole into which the tubular projection of the adjacent cartridge, which is coupled to the tubular body, is fitted in the longitudinal direction of each cartridge so that the tubular projection is held in the insertion hole removable from it. The former tubular projection has an insertion hole in which the core unit of the adjacent cartridge is housed. The circumferential outside of the tubular body has at least one engagement projection and at least one engagement groove, each of which can be engaged with the engagement groove or engagement projection of the tubular body of another cartridge so as to couple the cartridge in parallel with each other in their transverse direction removably from each other.

3 Claims, 3 Drawing Sheets

WRITING INSTRUMENT

BACKGROUND OF THE INVENTION

The present invention relates to a writing instrument which is meant in a broad sense and in which a plurality of cartridges are fitted and coupled in series with each other in the longitudinal direction thereof so that the cartridges are removable from each other.

A conventional writing instrument of such kind was disclosed in the Japanese Utility Model Publication No. 14633/85. In the writing instrument, a plurality of cartridges having cores at the tips of the cartridges are fitted and coupled with each other in the longitudinal direction thereof removably from each other and then housed in an outer cylinder of relatively large length. The core of the foremost cartridge is protruded from the tip of the outer cylinder to write a character or the like by the core. When the core of the foremost cartridge is worn out due to the writing, the cartridge is pulled out of the outer cylinder from the tip thereof and inserted into the outer cylinder from the butt thereof so that the second foremost cartridge in the outer cylinder is moved to the tip thereof by being pushed and the core of the cartridge is protruded from the tip of the outer cylinder in order to be used for writing. Since the plural cartridges are sequentially moved by being pushed, to continually use the writing instrument, the instrument cannot be used even if only one of the cartridges is lost. This is a problem. Since the holding pressure on the writing instrument at the time of writing cannot be withstood only by the cartridges coupled in series with each other, the instrument cannot be used without the outer cylinder. Therefore, the outer cylinder is needed. This is another problem. Besides, the cartridges whose cores are worn out due to writing can be discarded but cannot be utilized for other uses such as being used as building blocks for toying. This is yet another problem.

SUMMARY OF THE INVENTION

The present invention was made in order to solve the abovementioned problems.

Accordingly, it is an object of the present invention to provide a writing instrument whose writing function can be performed without an outer cylinder and whose cartridges can be also used as building blocks for toying.

In the writing instrument, the plural cartridges are fitted and coupled in series with each other in the longitudinal direction thereof so that the cartridges are removable from each other. Each of the cartridges comprises a tubular body having a tubular projection at one end of the tubular body and having an optionally shaped cross section, and a core unit inserted in the tubular projection so that the core unit is held therein. The tubular body has an insertion hole into which the tubular projection of the adjacent cartridge, which is coupled to the tubular body, is fitted in the longitudinal direction of each cartridge so that the tubular projection is removably held in the hole. The former tubular projection has an insertion hole in which the core unit of the adjacent cartridge is housed. The circumferential outside of the tubular body has at least one engagement projection and at least one engagement groove, each of which can be engaged with the engagement groove or engagement projection of the tubular body of another cartridge to removably couple the cartridges in parallel with each other in the transverse direction thereof.

Since the tubular projection of one of the cartridges adjacent to each other is removably held in the insertion hole of the tubular body of the other of the cartridges by being fitted in the hole and the core unit of the former cartridge is housed in the insertion hole of the tubular projection of the latter cartridge so that the cartridges are removably coupled to each other in the longitudinal direction thereof, the writing instrument does not need an outer cylinder such as that of the conventional writing instrument. If the core of the foremost cartridge is worn out, the cartridge is easily removed from the second foremost cartridge and coupled to the rearmost cartridge so that writing can be performed by the core unit of the second foremost cartridge. Even if one of the cartridges is lost, the writing instrument can be properly used although the length thereof is decreased. Therefore, in such a case, it does not become impossible to perform writing with the writing instrument but it does to do so with the conventional writing instrument. Since the engagement projections and engagement grooves of the circumferential outsides of the tubular bodies of some cartridges can be engaged with the engagement grooves and engagement projections of the circumferential outsides of other cartridges to removably couple the cartridges in parallel with each other in the transverse direction thereof, the cartridges can be used as building blocks for toying. Particularly when the cores of the core units of the cartridges are worn out, the cartridges can be used as such blocks to perform waste recycling. If the writing instrument has a plurality of cartridges coupled in parallel with each other in the transverse direction thereof, a plurality of lines can be simultaneously drawn with the instrument.

DETAILED DESCRIPTION OF EXEMPLARY EMBODIMENT

An embodiment of the present invention is hereafter described in detail with reference to FIGS. 1, 2, 3, 4, 5 and 6.

Figure 1:
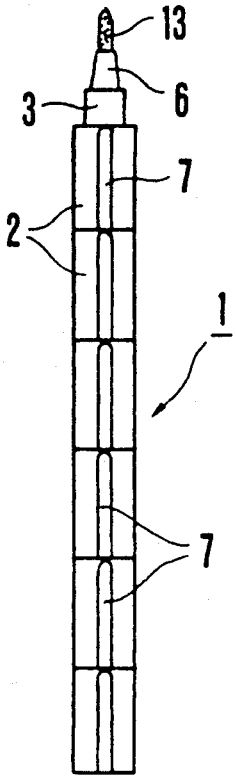
FIG. 1 is a front view of a writing instrument which is an embodiment of the present invention.
Figure 2:
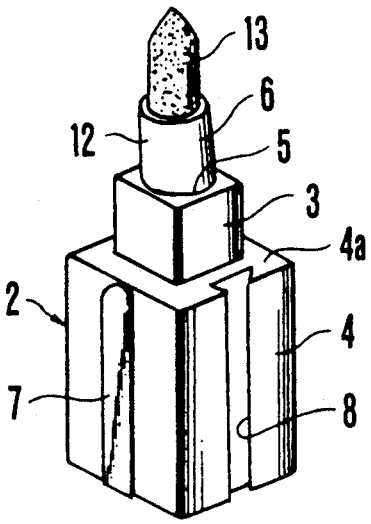
FIG. 2 is an enlarged perspective view of the cartridge of the writing instrument.
Figure 3:
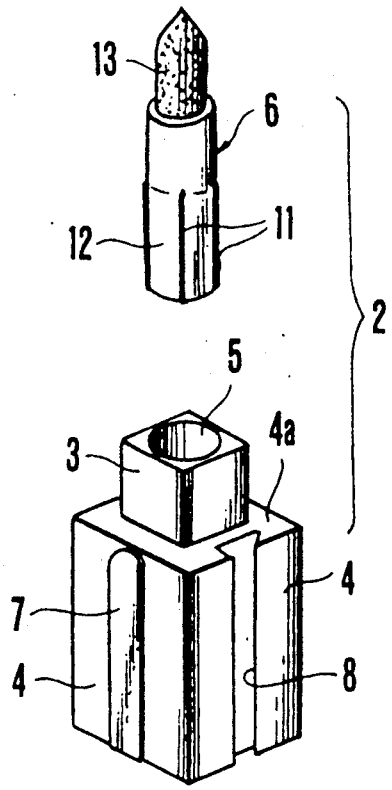
FIG. 3 is an enlarged exploded perspective view of the cartridge.

FIG. 1 shows a writing instrument 1 which is the embodiment. In the writing instrument 1, a relatively large number of cartridges 2 are fitted and coupled in series with each other in the longitudinal direction thereof removably from each other, so that the instrument is put in a state of being capable of being used.

As shown in FIGS. 2, 3, 4, 5 and 6, each of the cartridges 2 comprises a tubular body 4 having a tubular projection 3 and a step 4a at one end of the body, and a core unit 6. The cross section of the tubular body 4 and that of the tubular projection 3 are squarely shaped similarly to each other. The cross section of the tubular body 4 is larger in size than that of the tubular projection 3. The tubular body 4 and the tubular projection 3 extend coaxially to each other. The tubular projection 3 has an insertion hole 5 open at one end of the projection. The tubular body 4 has an insertion hole 9 open at the other end of the body. The insertion holes 5 and 9 are coaxial and continuous to each other. A pair of stoppers 10 project toward each other from the inside surface of each cartridge 2 at the boundary of the insertion holes 5 and 9. The number of the stoppers 10 is not limited to two but may be one or more. The cross section of the insertion hole 5 of the projection 3 is circularly shaped. The cross section of the insertion hole 9 of the body 4 is squarely shaped similarly to the outline of the cross section of the tubular projection 3 and has such a size that the tubular projection 3 of the adjacent cartridge 2 is held in the insertion hole by being fitted therein. Engagement projections 7 are provided on two mutually opposite sides of the tubular body 4 at the centers of the widths of the sides, and extend in the longitudinal direction of the body along nearly the total length thereof. Engagement grooves 8 are provided in the other two mutually opposite sides of the tubular body 4 at the centers of the widths of the sides, and extend in the longitudinal direction of the body along the total length thereof. The cross section of each of the engagement projections 7 has such a trapezoidal form that the width of the projection is smaller at the bottom thereof than at the top thereof. The cross section of each of the engagement grooves 8 has such a trapezoidal form that the cross section corresponds to that of each of the engagement projections 7 and the width of the groove is larger at the bottom thereof than at the top thereof.

The core unit 6 comprises a core holder 12 shaped nearly cylindrically, and a core 13 such as pencil lead. The core 13 is fixedly fitted at the butt thereof in the core holder 12. The core 13 projects by a prescribed length from the tip of the core holder 12 in the longitudinal direction thereof. A projection not shown in the drawings is provided on the inside circumferential surface of the core holder 12 and supports the core 13 so that the core is prevented from moving toward the butt of the core holder in the longitudinal direction thereof. The inside diameter of the core holder 12 is slightly larger at the portion of the holder between the projection and the butt of the holder than at the other portion thereof so that the core 13 can be inserted into the former portion. A number of projections 11 are provided on the outside circumferential surface of the half portion of the core holder 12 at the butt thereof so that the projections are located at equal intervals along the circumference of the holder and extend in the longitudinal direction thereof. The other half portion of the core holder 12 at the tip thereof is tapered toward the tip so that the appearance of the core holder is good. The latter half portion of the holder 12 may not be tapered. The projections 11 may not be provided if the core holder 12 without the projections can be fitted in the insertion hole 5 of the tubular projection 3 of the adjacent cartridge 2 with appropriate tightness or friction as described hereinafter.

Figure 4:
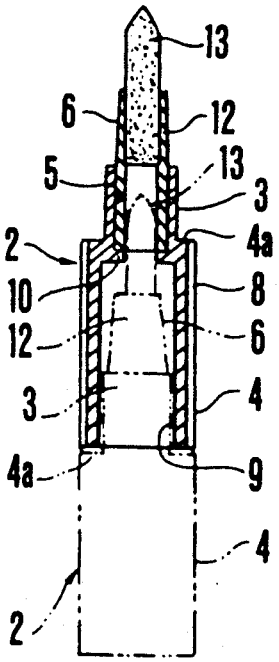
FIG. 4 is a longitudinally sectional view of the cartridge.
Figure 5:
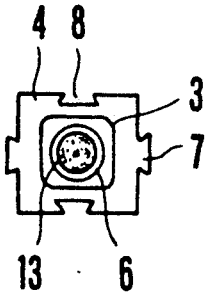
FIG. 5 is a plan view of the cartridge.
Figure 6:
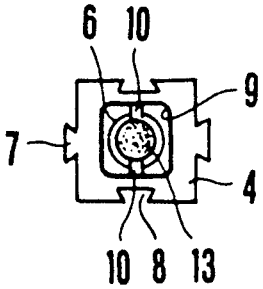
FIG. 6 is a bottom view of the cartridge.
Figure 7:
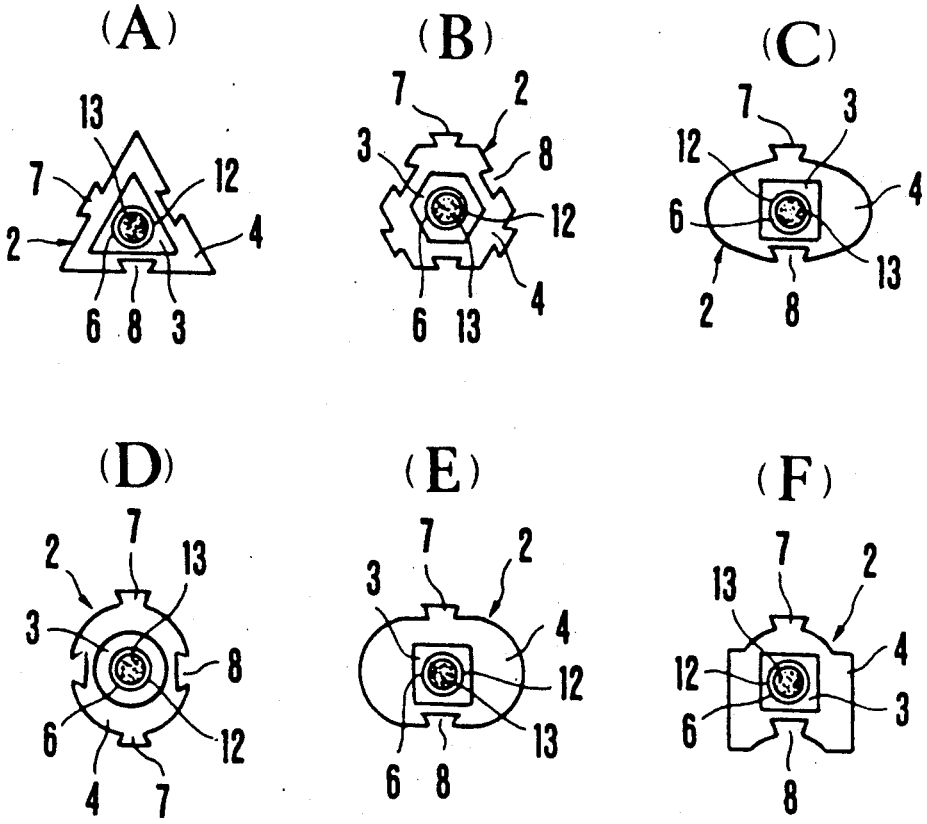
FIGS. 7(A), 7(B), 7(C), 7(D), 7(E) and 7(F) are plan view of mutually different modifications of the cartridge.

The core holder 12 of the core unit 6 of each cartridge 2 is removably held in the insertion hole 5 of the tubular projection 3 of the tubular body 4 thereof by being fitted into the hole from the tip of the projection, and the butt of the holder is put in contact with the stopper 10, so that the cartridge is assembled as shown in FIG. 4. In that state, the tubular projection 3 extends from the step 4a of the tubular body 4, the half portion of the core holder 12 at the tip thereof projects from the tubular projection, and the core 13 projects from the core holder, so that the cartridge 2 having the core at the center of the cartridge is constituted as if the cartridge is made of coaxially overlapped cylinders having steps. The tubular projection 3 of one of the cartridges 2 each assembled as described above is removably held in the insertion hole 9 of the tubular body 4 of another of the cartridges by being fitted in the hole, so that the core holder 12 and core 13 of the former cartridge are housed in the insertion hole 9 of the latter cartridge and the half portion of the core holder of the latter cartridge at the butt of the core holder thereof. At that time, the step 4a of the tubular body 4 of the former cartridge 2 is put in contact with the butt of the tubular body 4 of the latter cartridge 2 so that both the cartridges are positioned relative to each other in the longitudinal direction thereof and a gap is set between the cores 13 of the cartridges to prevent the cores from being damaged by each other. Such operation is repeated to couple a desired number of the cartridges 2 in series with each other in the longitudinal direction thereof by fitting the cartridges on each other, as shown in FIG. 1, to assemble the writing instrument 1 of such length that it is easy to perform writing with the core 13 of the foremost cartridge.

Figure 8:
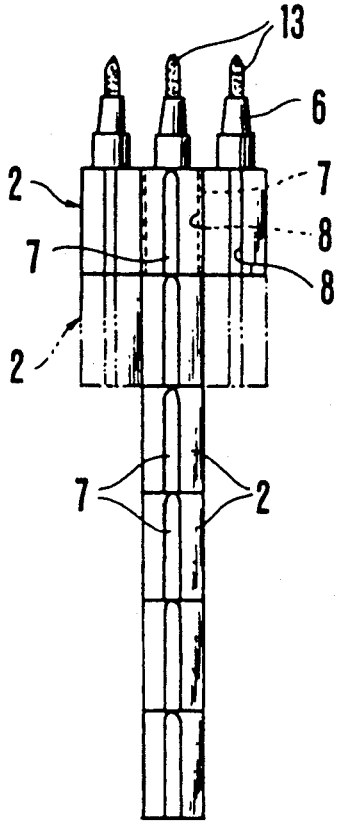
FIG. 8 is a front view of the cartridges coupled to each other in the transverse direction thereof in a manner.

The engagement projection 7 provided on the circumferential outside of the tubular body 4 of another of the cartridges 2 can be engaged in the engagement groove 8 of the tubular body 4 of the foremost cartridge 2 of the assembled writing instrument 1 on at least one side of the foremost cartridge so that both the cartridges are removably coupled in parallel with each other in the transverse direction thereof as shown in FIG. 8. If such coupling is performed, one or more lines, which are straight lines or curved or other irregular lines, can be easily, accurately and simultaneously drawn in parallel with each other by the single movement of the writing instrument 1 without using parallel rulers. For that reason, the writing instrument 1 can be conveniently used to draw or write a pattern, an advertizing picture, a block character or the like.

When the core 13 of the foremost cartridge 2 of the writing instrument 1 is worn out to be unusable, the cartridge is removed from the second foremost cartridge 2 and coupled to the rearmost cartridge 2 so that the core of the second foremost cartridge is used for writing or drawing.

Figure 9:
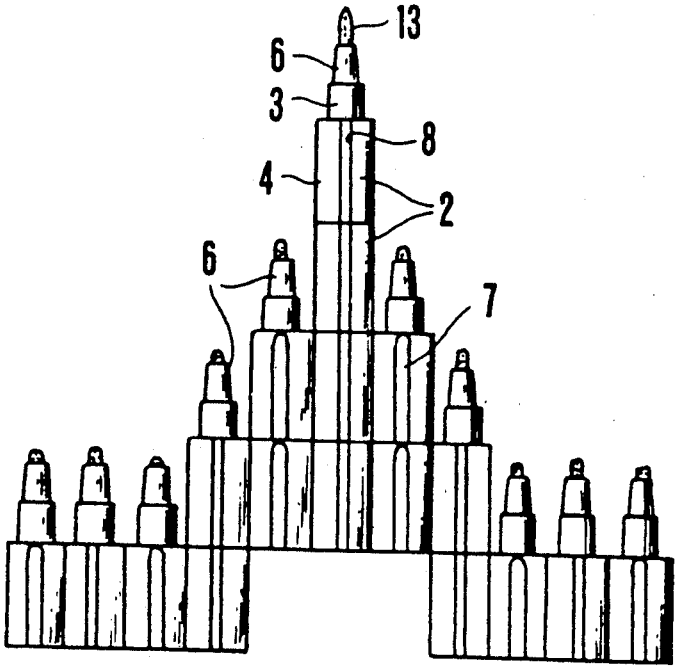
FIG. 9 is a front view of the cartridges coupled to each other in the transverse direction thereof in another manner.

As shown in FIG. 9, the cartridges 2 can be optionally coupled to each other as building blocks for toying, in the longitudinal direction and/or transverse direction thereof, to constitute a model cathedral, airplane, animal, house, bridge or the like to develop the imagination ability of a child or the like, whether the cores 13 of the cartridges are worn out or not. If the cores 13 are worn out, the cartridges 2 can be used as building blocks for toying, to perform waste recycling to attain thriftiness.

Since the core units 6 are removably inserted into the tubular projections 3 of the tubular bodies of the cartridges 2, the cores 13 of the core units can be made of mutually different materials such as colored lead, charcoal, crayon, chalk, a ball-point pen ink and holder, a felt-tip pen ink and holder, an eyebrow pencil and a lipstick which are identical with each other or different from each other in color and/or quality and herein regarded as writing materials in a broad sense.

It may be performed that the core 13 of at least one of the cartridges 2 is made of an eraser and the cores of the others of them are made of pencil lead or the like.

If the core 13 of each cartridge 2 is made of crayon, an eyebrow pencil, a lipstick or the like which has a relatively large diameter, the unit 6 may not have the core holder 12 and the core may be directly fitted in the insertion hole 5 of the tubular projection 3 of the tubular body 4 so that the core is removably or irremovably held in the hole. In that case, the length of each core 13 is predetermined or the length of each insertion hole 5 is increased in advance so that the tip of the core of the anterior cartridge 2 is prevented from coming into contact with the butt of the core of the posterior adjacent cartridge 2.

The outline of the cross section of each core unit 6 may be shaped as a circle, an angular figure, an ellipse or the like to correspond to that of the cross section of each tubular projection 3.

Although the engagement projections 7 and the engagement grooves 8 are alternatively provided on the four sides of each tubular body 4 of square cross section in the above-described embodiment, the present invention is not confined thereto but may be otherwise embodied so that the engagement projections are provided on two mutually adjacent sides of each tubular body and the engagement grooves are provided in the other two mutually adjacent sides of the tubular body. The present invention may be still otherwise embodied so that at least one engagement projection 7 and at least one engagement groove 8 are provided on optional sides of each tubular body 4 to couple the cartridges 2 to each other in the transverse direction thereof without hindrance. Besides, a single engagement projection 7 and a plurality of engagement grooves 8 may be provided on the sides of each tubular body 4. Although the cross section of each of the engagement projections 7 and the engagement grooves 8 are trapezoidally shaped in the above-described embodiment, the present invention is not confined thereto but may be otherwise embodied so that the cross section is shaped as T or otherwise.

Although the cross sections of the tubular body 4 and tubular projection 3 of each cartridge 2 are squarely shaped in the above-described embodiment, the present invention is not confined thereto but may be otherwise embodied so that the cross sections are shaped as triangles, polygons such as hexagons, ellipses, circles or others, as shown in FIGS. 7(A), 7(B), 7(C), 7(D), 7(E) and 7(F), to increase the variety of the forms of the cross sections and the number of combinations of designs thereof.

It is preferable that the parts of each cartridge 2 except the core 13 are mass-produced from a thermoplastic resin by injection molding.

Although the engagement projections 7 and the engagement grooves 8 slenderly extend in the longitudinal direction of each tubular body 4 in the above-described embodiment, the present invention is not confined thereto but may be otherwise embodied so that the engagement projections and the engagement grooves slenderly extend in the transverse direction of the tubular body.

What is claimed is:

1. A marking instrument comprising:

(A) a core unit comprising a coloring substance; and (B) a plurality of cartridges, each comprising:

(i) a tubular body having a longitudinal axis and a first end and a second end;

(ii) a tubular projection formed integrally and coaxially with said first end of said tubular body, said tubular projection having a first insertion hole defined therethrough coaxially with said tubular projection and tubular body, said tubular body having a second insertion hole defined therethrough at said second end of said tubular body, said core unit being insertable into said first insertion hole and tightly retained therein;

(iii) at least one engagement projection formed parallel to said longitudinal axis of said tubular body and extending axially along nearly the total length of said tubular body, said engagement projection widening outward from said tubular body; and (iv) at least one engagement recess, formed parallel to said longitudinal axis of said tubular body and extending nearly the total length of said tubular body, said engagement recess widening from the outer surface of said tubular body inward, wherein a plurality of said cartridges can be fitted and coupled together in a longitudinal direction by fitting said tubular projection of one cartridge to the second insertion hole of another cartridge, and laterally by slidably engaging the engagement projection of a cartridge with the engagement recess of a parallel cartridge.

2. The marking instrument as recited in claim 1, wherein said core unit consists of a coloring substance having a tip and a butt, said butt being sized to be tightly but removably received in said first insertion hole such that said tip projects outward from said first insertion hole.

3. The marking instrument as recited in claim 1 wherein said core unit comprises:

(A) a core holder; and (B) a core consisting of a coloring substance, wherein said core has a tip and a butt, said butt being tightly held in said core holder, said core holder sized to be removably receivable in said first insertion hole such that said tip projects outward from said first insertion hole.

* * * * *